US005242070A

United States Patent [19]

Bretschneider et al.

[11] Patent Number: 5,242,070

[45] Date of Patent: Sep. 7, 1993

[54] FREIGHT CONTAINER, IN PARTICULAR AIR FREIGHT CONTAINER

[75] Inventors: Gert Bretschneider, Hilzingen; Ulf Hartmann, Rielasingen; Eugen Ryziuk, Singen; Dieter Kiesewetter, Radolfzell; Albrecht Löble, Oehningen, all of Fed. Rep. of Germany

[73] Assignee: Alusuisse-Lonza Services, Ltd., Zurich, Switzerland

[21] Appl. No.: 943,066

[22] Filed: Sep. 10, 1992

[30] Foreign Application Priority Data

Sep. 19, 1991 [CH] Switzerland ..... 2784/91

[51] Int. Cl.[5] ..... B65D 90/56

[52] U.S. Cl. ..... 220/1.5; 160/290.1; 220/326; 220/305

[58] Field of Search ..... 160/290.1, 275; 220/1.5, 326, 324, 305; 190/119

[56] References Cited

U.S. PATENT DOCUMENTS

| | | | |
|---|---|---|---|
| 1,111,086 | 9/1914 | Olson | 160/290.1 |
| 1,424,375 | 8/1922 | Palt | 160/290.1 |
| 2,089,876 | 8/1937 | Cavedo | 160/290.1 |
| 3,618,803 | 11/1971 | Dobberkau | 220/1.5 |
| 3,883,026 | 5/1975 | Selz | 220/1.5 |
| 3,911,992 | 10/1975 | Webb | 160/290.1 |
| 4,726,486 | 2/1988 | Masuda | 220/1.5 |
| 5,109,998 | 5/1992 | Bretschneider | 220/1.5 |

FOREIGN PATENT DOCUMENTS

| | | |
|---|---|---|
| 582509 | 3/1989 | Australia . |
| 314711 | 7/1929 | United Kingdom . |

*Primary Examiner*—Allan N. Shoap
*Assistant Examiner*—S. Castellano
*Attorney, Agent, or Firm*—Bachman & LaPointe

[57] ABSTRACT

The freight container, in particular air freight container, comprises a door opening bounded by lateral vertical posts which door opening is closable by a rigid or roll-up container door fixed at one end and lockable in the closed position by bolts which are arranged on a door bar or the like closure profile and which can be introduced into mating elements on the container frame. Here, the locking bolts are rigidly connected to the door bar. At least one of the locking bolts can be inserted in a corresponding latching recess in the container frame on the front side, and there is provided a locking tongue slidable on the front side over the insertion opening of the latching recess.

16 Claims, 4 Drawing Sheets

FREIGHT CONTAINER, IN PARTICULAR AIR FREIGHT CONTAINER

BACKGROUND OF THE INVENTION

The invention concerns a freight container, in particular, an air freight container, with at least one door opening bounded by lateral vertical posts, which door opening is closable by a rigid or roll-up container door fixed at one end and lockable in the closed position by means of bolts which are arranged on a door bar or the like closure profile and which can be introduced into mating elements on the container frame.

Air freight containers of this kind are known, wherein horizontally movable locking bolts are arranged on the lower closure profile or door bar of a flexible container door. The locking bolt is in this case provided with a welded-on loop which extends upwards through a corresponding slot in the door bar profile out of the door bar. Furthermore the locking bolt is guided over a bearing block attached to the door bar and biased into the closed position by a spring, so that the locking bolt always remains in the locked position in the unloaded state. Locking is brought about by introducing the locking bolt into a corresponding oval hole in the container post. A disadvantage with air freight containers of this kind is that the locking system is located on the flexible door and consequently the oval hole cannot be inspected for feeding in the locking bolt from the operator side.

In the light of this state of the art, the inventor set himself the aim of improving the closure of such a freight container by means of an operator-friendly locking system.

SUMMARY OF THE INVENTION

This object is achieved by the fact that the locking bolts are rigidly connected to the door bar, wherein at least one of the locking bolts can be inserted in a corresponding latching recess in the container frame on the front side and locked in the latching recess by means of a blocking element.

As the blocking element there may be provided a locking tongue slidable on the front side over the insertion opening of the latching recess or a catch with a free end pivotable over the locking bolt inserted in the latching recess.

Due to transfer according to the invention of the movable locking system from the container door to the more stable container frame, there are fewer problems in handling the door. The latching recess, which is accessible from the front, has the crucial advantage over the locking system according to the state of the art that precise positioning of locking bolt and oval hole is eliminated. Another advantage of the construction according to the invention is that without extra expenditure it is clearly visible at any time from the operator side whether the door is correctly locked or not, whereby the previous defect is remedied. Added to this is the fact that the arrangement of latching recess and locking bolt allows substantially easier feeding of the locking bolt into the locking mechanism, as a result of which extra security in locking the container door is provided.

In the construction with locking tongue, the latter is advantageously arranged inside the vertical post constructed as a hollow profile and held in the closed position by a locking bar. In this case, an actuating element which passes through a corresponding opening in the vertical post is fixed to a locking element comprising the locking tongue or connected thereto, for sliding the locking tongue into its open position. The locking bar can be rigidly connected to the locking element or simply rest on it in butting relationship. The last-mentioned construction has the advantage that in case of deformation of the vertical post, the locking mechanism jams less easily than with a rigid connection between locking bar and locking element. If the locking bar is rigidly connected to the locking element, the actuating element can of course also be fixed to the locking bar. The locking tongue is preferably held in the closed position by spring force. However, this blocking action can also be obtained in a different way, for example by latching the locking bar in a corresponding recess.

The opening in the vertical post is preferably provided in the outer profile wall of the vertical post, wherein in this case the actuating element is an actuating pin. In another embodiment, the opening is provided in the front profile wall of the vertical post and the actuating element is a handle fixed with screws or the like connecting elements and encompassing the vertical post at the front.

Locking element and locking tongue are preferably guided in sliding relationship on the inner surface of the front profile wall of the vertical post.

In one expedient construction the locking tongue is the free end of a rectangular bar, wherein the locking bar rests on the other end of the rectangular bar or is rigidly connected thereto.

In another expedient construction the locking tongue is the bottom portion of a profile piece of U-shaped cross-section with side walls cut back in the region of the latching recess, wherein the locking bar rests on the profile piece or is connected thereto.

According to another characteristic of the invention the latching recess is formed in the inner profile wall of the vertical post by a conically tapering slot with guide edges for the locking bolt.

In one advantageous design of the locking system the locking bar is surrounded by a coil spring arranged inside the short arms of a bearing block of C-shaped cross-section fixed to a profile wall of the vertical post. This spring is held at one end by a locking pin passing through the locking bar.

In the construction with catch, the latter is arranged inside the vertical post constructed as a hollow profile, and lies with a peripheral surface, which is approximately cylindrical in the region of its axis of rotation, opposite a concave sliding surface of a thrust bearing fixed to a profile wall of the vertical post. In this case the axis of rotation of the catch is preferably simultaneously the axis of rotation of an actuating lever passing through the outer profile wall and rigidly connected to the catch.

The catch is preferably held in the closed position automatically by a spring. However, the blocking action can also be obtained in a different way, for example by fixing the actuating lever in its closed position.

BRIEF DESCRIPTION OF THE DRAWINGS

Further advantages, characteristics and details of the invention are shown by the description below of preferred embodiments as well as with the aid of the drawings; these show.

DESCRIPTION OF THE PREFERRED EMBODIMENTS

Figure 1:
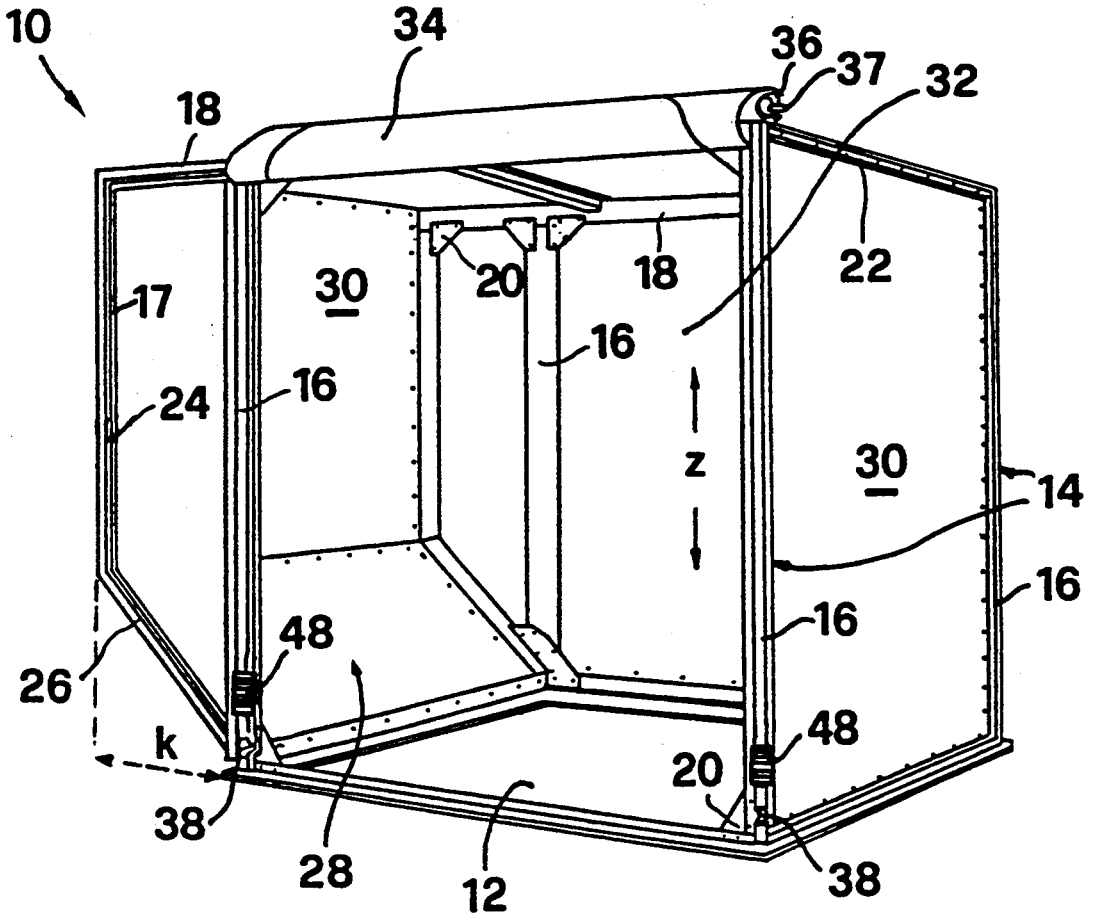
FIG. 1: an oblique view of an air freight container.

A freight container 10 for air transport is provided above a bottom panel 12 with a supporting structure which comprises two side frames 14 each with two vertical posts 16 and a ridge profile 18, wherein at the corners between individual profile portions there are gussets or corner plates 20 and also the parallel ridge profiles 18 of the two side frames 14 are connected to each other at the ends by transverse profiles 22.

The ridge profiles 18 extend by an amount k beyond the vertical posts 16, which are on the left in FIG. 1, or beyond the bottom panel 12, and adjoining their respective profile end is a vertical bar 24 which ends at a distance from the plane of the bottom panel 12 and also is connected by an inclined bottom profile 26 to the region of that bottom panel 12. The adjoining vertical post 16 forms with the vertical bar 24 and the sloping bottom profile 26 the contour of a so-called container balcony 28. The framed areas between the hollow profiles 16, 18, 22, 24 and 26 of the freight container 10 are, seen from a door opening 32 which is at the front in FIG. 1, filled in with sheet metal panels 30 as planking, which are attached to profile webs 17 of those profiles by riveting.

The door opening 32 in the side frame 14 which is at the front in FIG. 1 is closable by a flexible container door 34 which can be rolled up in rolling direction z. At its lower end the container door 34 is provided with a door bar or closure profile 36 with lateral stationary locking bolts 37 which, on closing the container door 34, are inserted in latching recesses 38 of the lateral vertical posts 16.

According to FIGS. 2 to 5 the locking bolt 37 is anchored in the profile interior of the door bar 36 and protrudes in an axial direction by an amount a beyond the profile end of the door bar 36. The locking bolt 37 is in the drawings inserted in the latching recess 38 arranged in the vertical post 16. By this latching recess 38 the inner profile wall **16*b* of the vertical post 16 is partially cut out to form a conically tapering slot with guide edges 16*c***.

In the vertical post 16, a C-shaped bearing block 39 is attached by rivets 40 to the inner profile wall **16*b* of the post. Through the two short arms 39*a,b* of the bearing block 39 extends a locking bar 41 which is axially surrounded by a coil spring 42 which at one end rests on the short arm 39*a* on the inside and at the other end is held by a locking pin 43 passing through the locking bar 41. The locking pin 43 rests on the lower short arm 39*b* in the absence of application of external force. On the upper the short arm 39*a* on the outside rests in addition a safety pin 44 which passes through the locking bar 41 and which, if the locking pin 43 breaks, prevents the locking bar 41 from falling through the bearing block 39**.

Figure 3:
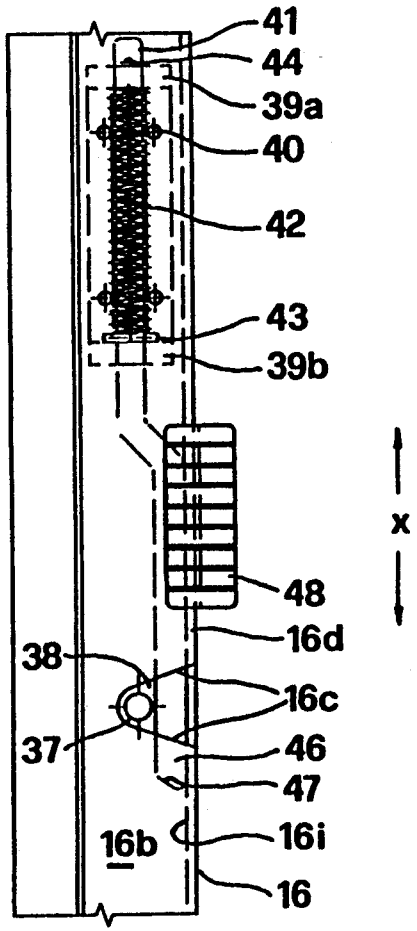
FIG. 3: a side view of FIG. 2 in viewing direction y.
Figure 2:
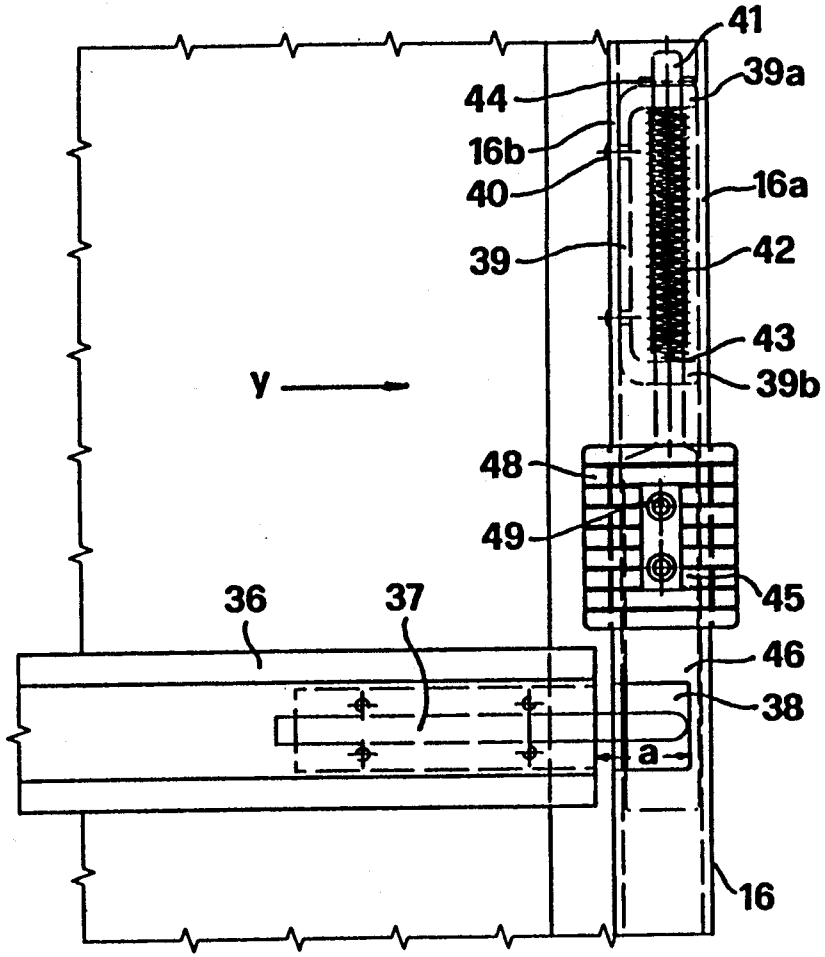
FIG. 2: a front view of a locking system of a container door.

In FIGS. 2 and 3, onto the locking bar 41 is welded a rectangular bar 45 which is adapted to the internal cross-section of the vertical post 16 and angled accordingly and which abuts slidingly against the inner surface **16*i* of the front profile wall 16*d* of the vertical post 16 and at its free end is constructed as a locking tongue 46 overlapping the locking bolt 37 inserted in the latching recess 38. The locking tongue 46 is provided at its free end towards the locking bolt 37 with a slope 47. According to another construction not shown in the drawings, the locking bar 41 rests on the rectangular bar 45 in butting relationship, wherein in this case the end of the rectangular bar 45 adjacent to the locking bar 41** may be of L-shaped cross-section, i.e. right-angled, to increase the bearing surface area.

The rectangular bar 45 is bolted to a handle 48 which encompasses the vertical post 16 at the front. The fixing screws 49 pass through a slot, not shown in the drawings, which allows and also limits vertical bolt movement as well as serving as an additional guide for the rectangular bar 45. By moving the handle 48 in a vertical sliding direction x against the spring force, the locking tongue 46 is displaced upwards, opening the latching recess 38, and releases the locking bolt 37. Without application of external force to the handle 48, the locking tongue 46 remains at all times in its closed position, i.e. the latching recess 38 is covered on the inside by the locking tongue 46 at the front profile wall **16*d* of the vertical post 16**.

Figure 5:
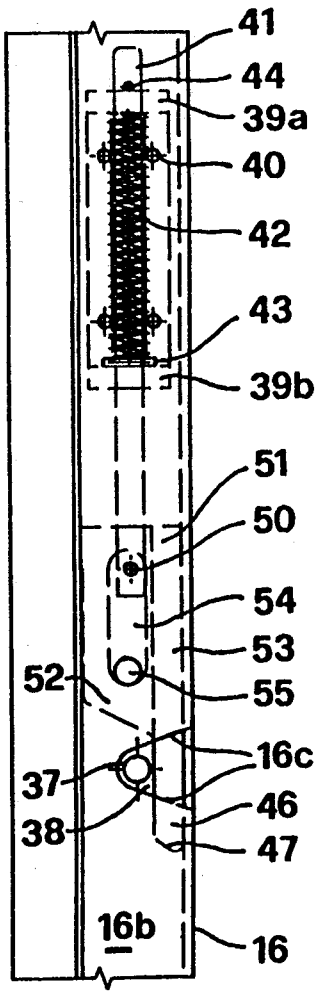
FIG. 5: a side view of FIG. 4 in viewing direction y.
Figure 4:
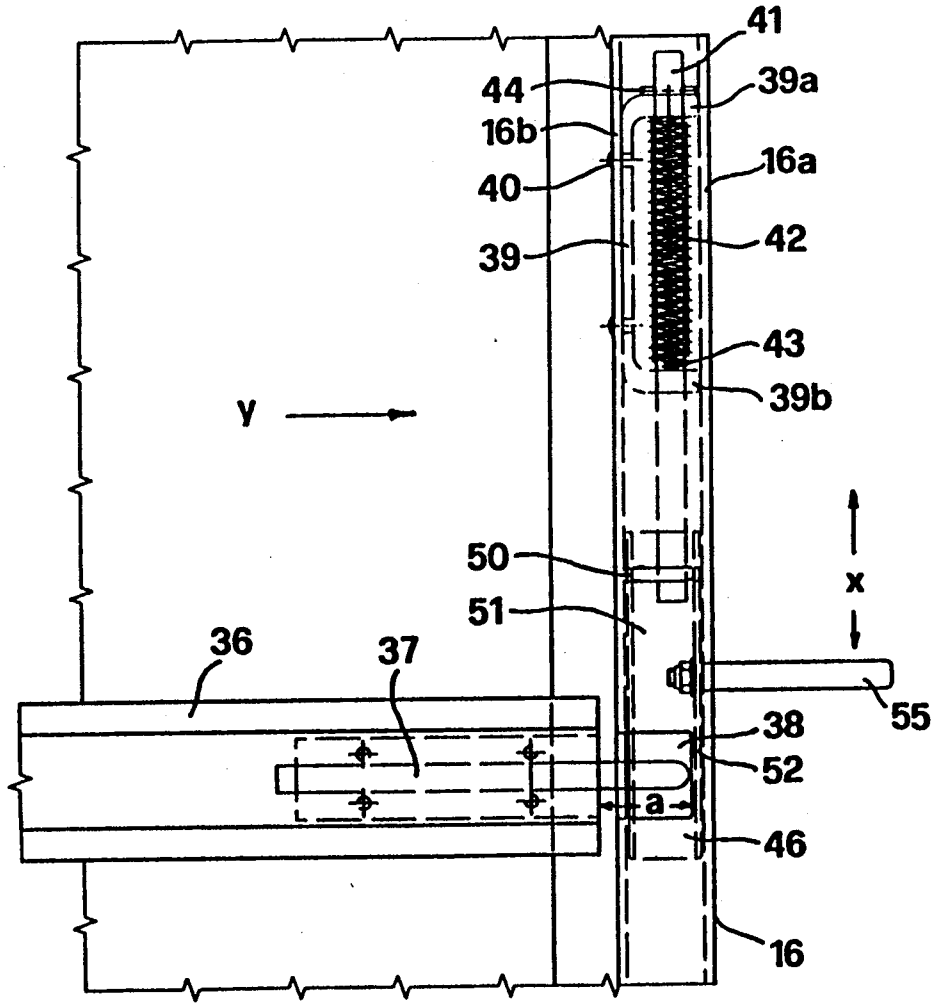
FIG. 4: a front view of another embodiment of the locking system.

In the embodiment of the locking system shown in FIGS. 4 and 5, the locking bar 41 is connected at the lower end, by a connecting pin 50 passing through it, to a profile piece 51 of U-shaped cross-section arranged in the vertical post 16. Here, the connecting pin 50 is not absolutely necessary, i.e. the locking bar 41 can simply rest on the end of the profile piece 51 adjacent thereto in butting relationship. The side walls 52 of this profile piece 51 are cut back in the region of the latching recess 38 in such a way that the thicker bottom portion 53 in the cut-back region forms the locking tongue 46. In the outer profile wall **16*a* of the vertical post 16, a slot 54 is cut out which lies in the direction of movement of the locking bar 41 and has an actuating pin 55 passing through it and is bolted fast to the side wall 52 of the profile piece 53** beneath it.

Similarly to the handle 48, movement of the actuating pin 55 in the vertical sliding direction x against the spring force leads to opening of the latching recess 38, while in the absence of application of external force the locking tongue 46 remains in its closed position.

In the two embodiments of the locking system shown in FIGS. 2 to 5, it can be seen immediately from the front whether the locking tongue 46 is covering the whole width of the opening of the latching recess 38 and hence the door is correctly locked.

Figure 7:
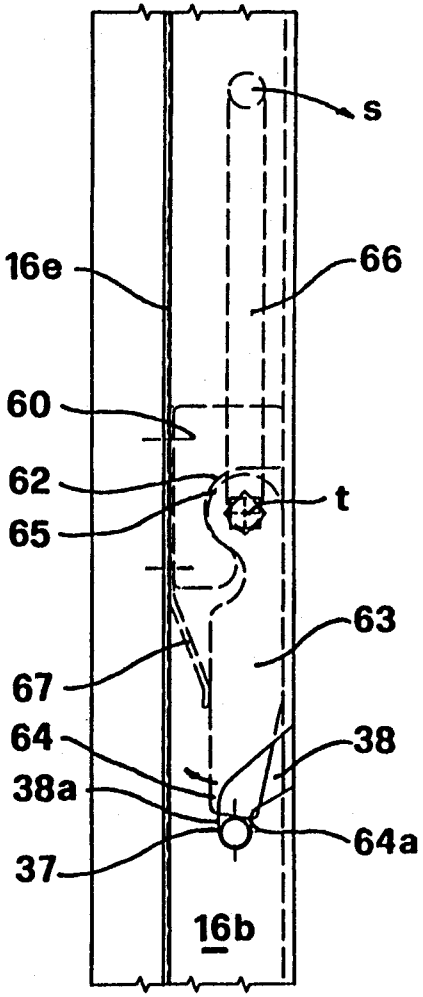
FIG. 7: a side view of FIG. 6 in viewing direction y.
Figure 6:
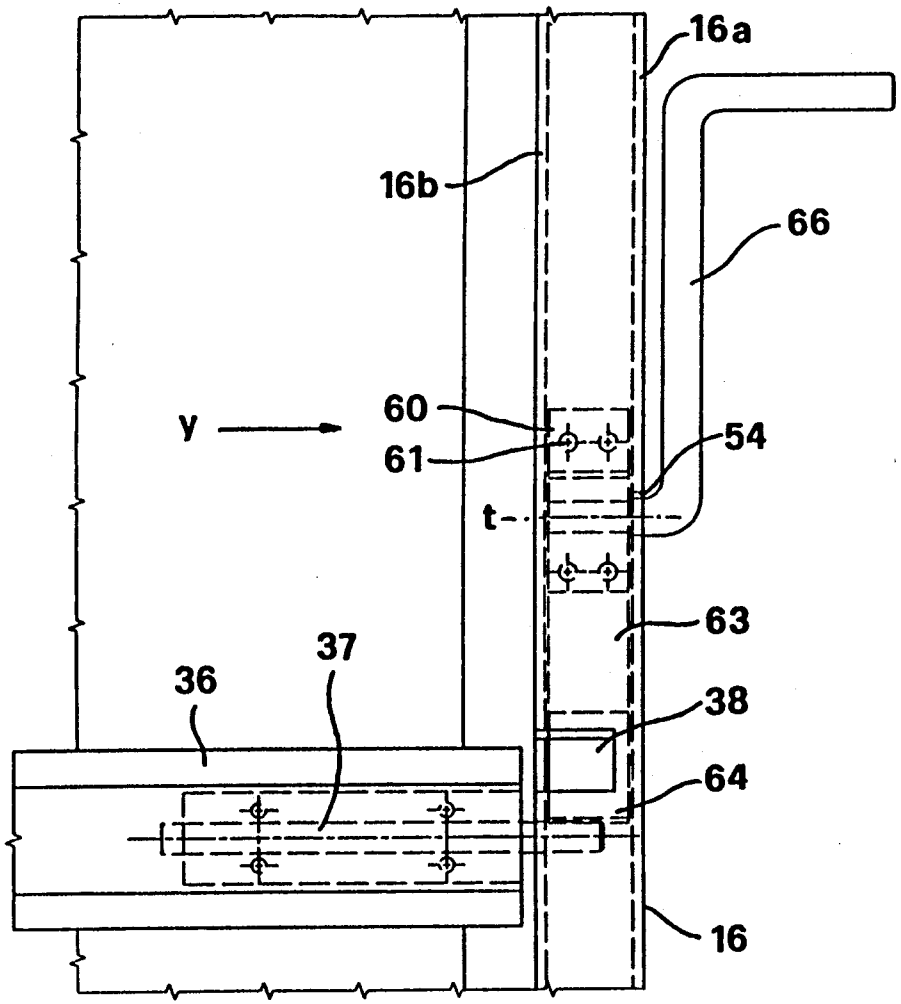
FIG. 6: a front view of another embodiment of the locking system.

In the embodiment of the locking system shown in FIGS. 6 and 7, the inner profile wall **16*b* is partially cut out by the latching recess 38, forming a conically tapering, downwardly sloping slot which leads into a vertically downwardly angled end portion 38*a* in which the locking bolt 37 is mounted. In the vertical post 16, fixed to the rear profile wall 16*e* thereof by means of screws 61 is a thrust bearing 60 which comprises a sliding surface 62 constructed concavely in a direction towards the front profile wall 16*d*. This sliding surface 62 lies opposite an approximately cylindrical peripheral surface 65 of and in the region of the axis of rotation t of a catch 63 which is provided at its free end 64 with an inclined surface 64*a* which ascends towards the rear profile wall 16*e* and which rests on the locking bolt 37** inserted in the latching recess 38. In the axis of rotation t is inserted the axis of rotation of an actuating lever 66 passing through the outer profile wall 16*a* via an opening 54 with vertical play.

By a spring 67 supported on the rear profile wall 16*e*, the catch 63 is automatically held in the closed position. By moving the actuating lever 66 in the direction of pivoting s, the catch 63 is pivoted against the force of the spring 67 towards the rear profile wall 16*e*, opening the end portion 38*a* of the slot of the latching recess 38, and releases the locking bolt 37. Without the application of external force to the actuating lever 66, the catch 63 remains at all times in its closed position, i.e. the end portion 38*a* of the latching recess 38 is covered by the free end 64 of the catch 63.

Although the freight container 10 shown in the drawings shows a flexible door 34 with a locking system arranged at the bottom, the invention is not confined to this embodiment. The flexible door may for example be hinged at the bottom, and the locking system arranged at the level of the ridge profile 18. Similarly, the locking system with the latching recess 38 may be provided on only one front vertical post 16, while the inner profile wall 16*b* of the other vertical post 16 comprises an ordinary oval hole for lateral insertion of the corresponding locking bolt. The locking system is of course not limited to flexible doors and can be arranged on the respective hollow profile of the container frame, in adaptation to the closed position of the door bar.

We claim:

1. Freight container, in particular an air freight container, which comprises: a container frame having a front side thereof and including at least one door opening bounded by lateral vertical posts, wherein the door opening is closable by a container door fixed at one end; at least one bolt rigidly connected to a door bar operative to be introduced into mating elements on the container frame and to lock the door in the closed position; wherein the one bolt is operative to be inserted in a corresponding latching recess in the container frame on the front side thereof and locked in the latching recess by a blocking element.

2. Freight container according to claim 1 wherein the latching recess has an insertion opening and wherein as the blocking element there is provided a locking tongue slidable on the front side over the insertion opening in the latching recess.

3. Freight container according to claim 1 wherein as the blocking element there is provided a catch with a free end pivotable over the one bolt inserted in the latching recess.

4. Freight container according to claim 2 wherein the locking tongue is arranged inside one of the vertical posts constructed as a hollow profile and automatically held in the closed position by a locking bar, wherein an actuating element which passes through a corresponding opening in the vertical post is connected to a locking element comprising the locking tongue, for sliding the locking tongue into its position.

5. Freight container according to claim 4 wherein the locking tongue is held in the closed position by spring force.

6. Freight container according to claim 4 wherein the corresponding opening is provided in an outer profile wall of the one vertical post and the actuating element is an actuating pin.

7. Freight container according to claim 4 wherein the corresponding opening is provided in a front profile wall of the one vertical post and the actuating element is a handle encompassing the one vertical post at the front thereof.

8. Freight container according to claim 4 wherein at least one of the locking element and the locking tongue are guided in sliding relationship on an inner surface of a front profile wall of the one vertical post.

9. Freight container according to claim 4 wherein the locking tongue is the free end of a rectangular bar and the locking bar is on the other end of the rectangular bar.

10. Freight container according to claim 4 wherein the locking tongue is the bottom portion of a profile piece of U-shaped cross-section with side walls thereof cut back in the region of the latching recess, wherein the locking bar is on the profile piece.

11. Freight container according to claim 4 wherein the latching recess is formed in an inner profile wall of the one vertical post by a conically tapering slot with guide edges for the one bolt.

12. Freight container according to claim 4 wherein the locking bar is surrounded by a coil spring arranged inside short arms of a bearing block of C-shaped cross-section fixed to a profile wall of the one vertical post.

13. Freight container according to claim 12 wherein the coil spring is held at one end by a locking pin passing through the locking bar.

14. Freight container according to claim 3 wherein the catch is arranged inside one of the vertical posts constructed as a hollow profile, and lies with a peripheral surface, which is approximately cylindrical in the region of its axis of rotation, opposite a concave sliding surface of a thrust bearing fixed to a profile wall of the one vertical post.

15. Freight container according to claim 14 wherein the axis of rotation of the catch is simultaneously the axis of rotation of an actuating lever passing through the outer profile wall and rigidly connected to the catch.

16. Freight container according to claim 3 wherein the catch is held in the closed position automatically by a spring.

* * * * *